US006572160B2

(12) United States Patent
Bunting

(10) Patent No.: US 6,572,160 B2
(45) Date of Patent: Jun. 3, 2003

(54) DOOR SAFETY BARRIER

(76) Inventor: Michael Christopher Bunting, 9139 Windknob Ct., Huntersville, NC (US) 28078

( * ) Notice: Subject to any disclaimer, the term of this patent is extended or adjusted under 35 U.S.C. 154(b) by 2 days.

(21) Appl. No.: 09/837,143

(22) Filed: Apr. 18, 2001

(65) Prior Publication Data

US 2001/0050486 A1 Dec. 13, 2001

Related U.S. Application Data

(60) Provisional application No. 60/211,231, filed on Jun. 12, 2000.

(51) Int. Cl.[7] ..... E05C 17/44

(52) U.S. Cl. ..... 292/342; 292/DIG. 15; 16/82; 16/85

(58) Field of Search ..... 292/342, DIG. 15, 292/DIG. 22, DIG. 4; 16/82, 85, 86, 86 A, 86 B, 86 R

(56) References Cited

U.S. PATENT DOCUMENTS

| | | | | | |
|---|---|---|---|---|---|
| 565,896 | A | * | 8/1896 | Harkness | 292/288 |
| 1,036,098 | A | * | 8/1912 | Harkness | 292/288 |
| 1,271,363 | A | * | 7/1918 | Ralston | 109/60 |
| 1,877,177 | A | * | 9/1932 | Hinderer | 292/175 |
| 1,895,146 | A | * | 1/1933 | Brown | 16/82 |
| 1,940,084 | A | * | 12/1933 | Grasso | 292/175 |
| 2,264,962 | A | * | 12/1941 | Adams | 292/147 |
| 2,500,416 | A | * | 3/1950 | Kaminski | 292/288 |
| 2,929,647 | A | * | 3/1960 | Gladstone | 16/82 |
| 3,330,585 | A | * | 7/1967 | Pollin | 292/153 |
| 3,909,877 | A | * | 10/1975 | Christy et al. | 16/49 |
| 4,303,266 | A | * | 12/1981 | Volpi | 16/85 |
| 4,343,500 | A | * | 8/1982 | Steiner | 16/82 |
| 4,601,502 | A | * | 7/1986 | Van Dyke | 16/82 |
| 4,763,937 | A | * | 8/1988 | Sittnick et al. | 292/251.5 |
| 4,765,664 | A | * | 8/1988 | Siegel | 292/288 |
| 4,797,970 | A | * | 1/1989 | Charlton | 16/82 |
| 4,823,432 | A | * | 4/1989 | Jan | 16/86 A |
| 5,018,241 | A | * | 5/1991 | Baines | 16/82 |
| 5,120,093 | A | * | 6/1992 | Carney | 16/82 |
| 5,395,143 | A | * | 3/1995 | Chesterton | 292/57 |
| D367,421 | S | * | 2/1996 | Powers | D8/402 |
| 5,590,918 | A | * | 1/1997 | Kambalov | 16/82 |
| 5,593,194 | A | * | 1/1997 | Liau | 292/163 |
| 5,653,487 | A | * | 8/1997 | Proni | 292/164 |
| 5,761,766 | A | | 6/1998 | Basham | |
| 5,775,746 | A | * | 7/1998 | Charlton | 292/219 |
| 5,806,900 | A | * | 9/1998 | Bratcher et al. | 292/137 |
| 6,321,412 | B1 | * | 11/2001 | Duco | 16/85 |
| 6,336,245 | B1 | * | 1/2002 | Sakakibara | 16/82 |

FOREIGN PATENT DOCUMENTS

| | | | | |
|---|---|---|---|---|
| DE | 10022880 | * | 2/2001 | E05F/5/08 |
| JP | 2000154680 | * | 6/2000 | E05F/5/02 |
| JP | 2001279996 | * | 10/2001 | E05F/5/00 |

* cited by examiner

*Primary Examiner*—Robert J. Sandy
*Assistant Examiner*—Matthew E. Rodgers
(74) *Attorney, Agent, or Firm*—Adams, Schwartz & Evans, P.A.

(57) ABSTRACT

A door safety barrier for being positioned adjacent a doorway having a door mounted therein for interfering with movement of the door relative to the doorway. The door safety barrier defines a security opening between the door and the doorway for preventing entry therethrough, and includes a housing for being embedded into a floor adjacent the door. The housing defines a chamber therein. An elongate plunger is positioned within the chamber for reciprocating movement between an extended, operative position above the floor for engaging a side of the door to prevent movement of the door past the plunger, and a retracted, inoperative position below the bottom of the door for permitting passage of the door over the plunger. A latch assembly cooperates with the housing and the plunger for alternately locking the plunger in the extended, operative and retracted inoperative positions, respectively.

18 Claims, 16 Drawing Sheets

DOOR SAFETY BARRIER

This application claims benefit of 60/211,231 filed Jun. 12, 2000.

TECHNICAL FIELD AND BACKGROUND OF THE INVENTION

This invention relates to a door safety barrier particularly intended to prevent an intruder from breaking through a door and gaining unwanted—and potentially unlawful—entry into a building. In many instances, the doors and doorways included in private dwellings such as apartments, condominiums or single-family homes are installed without including any type of supplemental protection other than conventional key-operated locks. While the doors in such dwellings typically include peepholes for viewing the area on the other side of the door, once the door is unlocked and opened, no other barrier is provided to prevent an intruder from gaining entry. Those dwellings which do include supplemental locking devices usually have conventional chain latches installed on the exterior doors and doorways. Although a chain latch will permit an individual to partially open a door to speak with a person standing outside the doorway, the poor construction and installation of the chain latch makes it an ineffective device for preventing the person outside from applying pressure to the door, breaking the chain latch, and gaining entry into the dwelling.

The door safety barrier of the present invention provides a simple and effective solution to the shortcomings of prior art chain latches and other supplemental locking devices. The door safety barrier is used in place of or in addition to a conventional chain latch or other locking device for permitting a door mounted in a doorway to be opened wide enough to permit parcels or packages to be passed through the doorway without allowing an intruder to enter the dwelling. The door safety barrier uses commonly available materials and components which may be easily and inexpensively manufactured and supplied to the user in many different forms, and takes advantage of a housing which is securely embedded into a floor adjacent a doorway. A steel plunger is positioned within the housing and is activated by a foot-actuated latching device contained within the housing to rise above the housing and floor to prevent the door from opening completely. Capable of withstanding over ½ ton of static pressure, the door safety barrier of the present invention allows an individual to partially open an exterior door without jeopardizing his or her safety by relying upon an ineffective prior art chain latch or other inadequate latching device, and thus decreasing the risk that an intruder will break down the door and ultimately gain access to the dwelling through the doorway.

SUMMARY OF THE INVENTION

Therefore, it is an object of the invention to provide a door safety barrier that functions as a door stop for allowing a door mounted within a doorway to be partially opened, while simultaneously preventing the door to be opened wide enough to permit an individual to step across the threshold of the doorway and gain unwanted entry into a private dwelling or other building.

It is another object of the invention to provide a door safety barrier that is inexpensive and easy to manufacture from commonly available components.

It is another object of the invention to provide a door safety barrier that may be easily installed in a floor adjacent a doorway either during construction of the dwelling or other building, or after such construction is completed.

It is another object of the invention to provide a door safety barrier which allows a door to be opened wide enough to pass packages or small items through the opening created between the door and doorway, yet prevents the door from being opened wide enough to permit an individual to enter through the doorway.

It is another object of the invention to provide a door safety barrier which includes a sensor system for permitting the door safety barrier to communicate with a remote alarm system. These and other objects of the present invention are achieved in the preferred embodiments disclosed below by providing a door safety barrier for being positioned adjacent a doorway having a door mounted therein. The door safety barrier is for interfering with movement of the door relative to the doorway and defines a security opening between the door and the doorway for preventing entry therethrough. The door safety barrier includes a housing for being embedded into a floor adjacent the door. The housing defines a chamber therein. An elongate plunger is positioned within the chamber for reciprocating movement between an extended, operative position above the floor for engaging a side of the door to prevent movement of the door past the plunger, and a retracted, inoperative position below the bottom of the door for permitting passage of the door over the plunger. A latch assembly cooperates with the housing and the plunger for alternately locking the plunger in the extended, operative and retracted inoperative positions, respectively.

According to one preferred embodiment of the invention, the door safety barrier includes a flange attached to an upper edge of the housing and adapted for being secured to an upper surface of the floor.

According to another preferred embodiment of the invention, the door safety barrier includes a plurality of spaced-apart holes defined by the flange and adapted for receiving screws therethrough for attaching the flange to the upper surface of the floor.

According to yet another preferred embodiment of the invention, the latch assembly includes an elongate rod having a first end positioned on an interior floor of the housing and a second end centrally disposed within a concentrically-positioned bore defined within and extending along the axial length of the plunger for supporting the plunger within the housing.

According to yet another preferred embodiment of the invention, the latch assembly further includes a spring formed around and extending along the length of the rod. The spring is captured between the floor of the housing and an interior surface defining the bore for moving the plunger through the opening of the chamber by expanding and contracting in response to the presence and absence, respectively, of downward pressure on an upper face of the plunger.

According to yet another preferred embodiment of the invention, the latch assembly further includes a follower member having a first end captured within the interior floor of the housing and a second end slidably engaging a complementary cam groove defined in a sidewall of the plunger for selectively moving the plunger between the extended, operative and retracted, inoperative positions.

According to yet another preferred embodiment of the invention, the second end of the follower member includes a hooked tip captured within the cam groove for selectively engaging complementary first and second release points defined within and interconnected by the cam groove for maintaining the plunger in the retracted, inoperative position and the extended, operative position, respectively, in the absence of downward pressure on the upper face of the plunger.

According to yet another preferred embodiment of the invention, the door safety barrier includes a sensor in communication with the door safety barrier for producing an alarm in response to motion stimuli detected by the sensor.

According to yet another preferred embodiment of the invention, the sensor is an electromagnetic sensor.

According to yet another preferred embodiment of the invention, the electromagnetic sensor includes a magnetic field sensitive device connected to the housing and cooperating with a complementary magnetic field producing device connected to the plunger.

According to yet another preferred embodiment of the invention, the electromagnetic sensor includes a magnetic field sensitive device connected to the plunger and cooperating with a complementary magnetic field producing device connected to the housing.

According to yet another preferred embodiment of the invention, the magnetic field sensitive device includes at least one Hall Effect sensor.

According to yet another preferred embodiment of the invention, the magnetic field producing device includes at least one magnet.

According to yet another preferred embodiment of the invention, the door safety barrier further includes at least one annular spacer positioned between the flange and the upper surface of the floor for preventing damage to the upper surface.

An embodiment of a method according to the invention is provided for constructing a seamless floor-to-wall baseboard from a resilient thermoplastic flooring material and adapting the baseboard to an outside corner. The method includes the step of providing a door safety barrier for being positioned adjacent a doorway having a door mounted therein for interfering with movement of the door relative to the doorway and defining a security opening between the door and the doorway for preventing entry therethrough. The door safety barrier includes a housing for being embedded into a floor adjacent the door and secured to an upper surface of the floor, said housing defining a chamber therein. An elongate plunger is positioned within the chamber for reciprocating movement between an extended, operative position above the floor for engaging a side of the door to prevent movement of the door past the plunger, and a retracted, inoperative position below the bottom of the door for permitting passage of the door over the plunger. A latch assembly cooperates with the housing and the plunger for alternately locking the plunger in the extended, operative and retracted inoperative positions, respectively. The method also includes the step of drilling a hole through the floor, the hole defined by cylindrical sidewalls adapted for receiving the housing therethrough. The door safety barrier is then positioned through the hole such that the housing engages the cylindrical sidewalls for permitting reciprocating movement of the plunger through the hole between the extended, operative and retracted, inoperative positions. The housing is then secured to the upper surface of the floor.

According to one embodiment of the method according to the invention, the securing step includes attaching a flange connected to an upper edge of the housing to the upper surface of the floor.

According to another embodiment of the method according to the invention, the securing step further includes placing a plurality of screws through complementary spaced-apart holes defined by the flange and adapted for receiving the screws therethrough for attaching the flange to the upper surface of the floor.

According to yet another embodiment of the method according to the invention, the method further includes the step of providing at least one annular spacer for being positioned between the flange and the upper surface of the floor for preventing damage to the upper surface.

According to yet another embodiment of the method according to the invention, the method further includes the step of positioning the at least one spacer around an exterior sidewall of the housing prior to positioning the door safety barrier through the hole.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
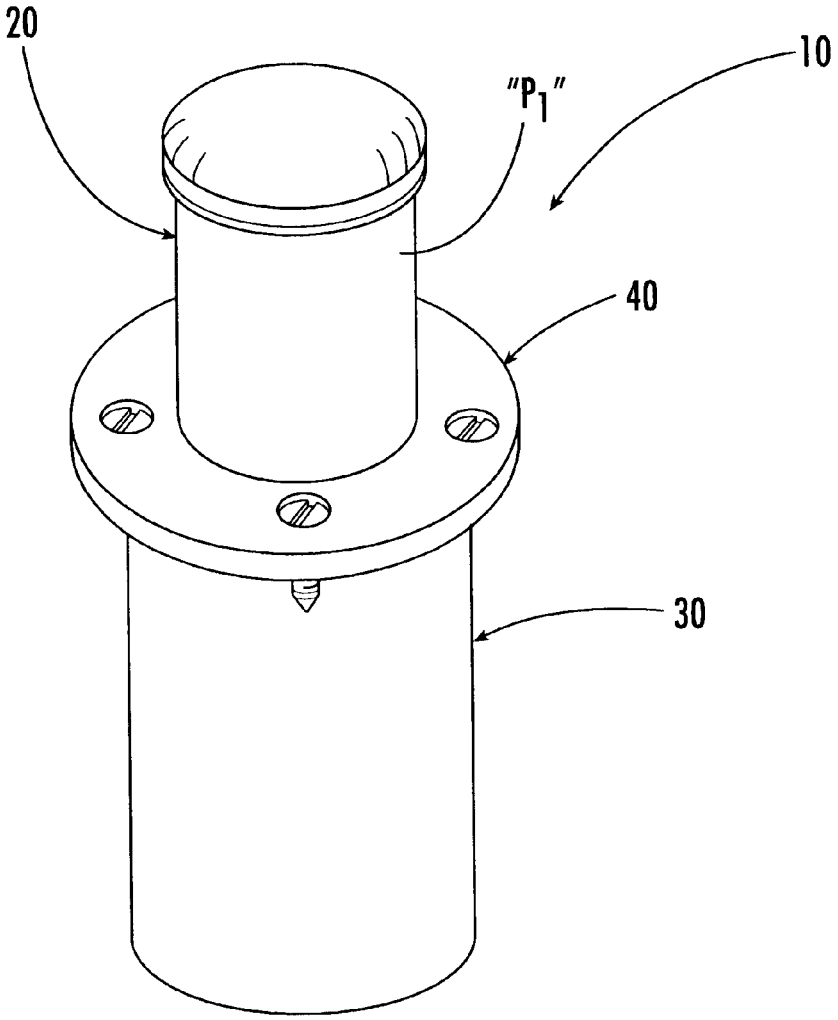
FIG. 1 is a perspective view of a door safety barrier according to one embodiment of the invention.

Referring now specifically to the drawings, a door safety barrier according to the present invention is illustrated in FIG. 1 and shown generally at reference numeral 10. The door safety barrier 10 includes a plunger 20 concentrically positioned within a housing 30, and an annular attachment plate 40 for anchoring the barrier 10 to a floor. Although the plunger 20 and housing 30 may be any shape or size, the plunger 20 and housing 30 each preferably have a vertically elongate, cylindrical shape.

Figure 2:
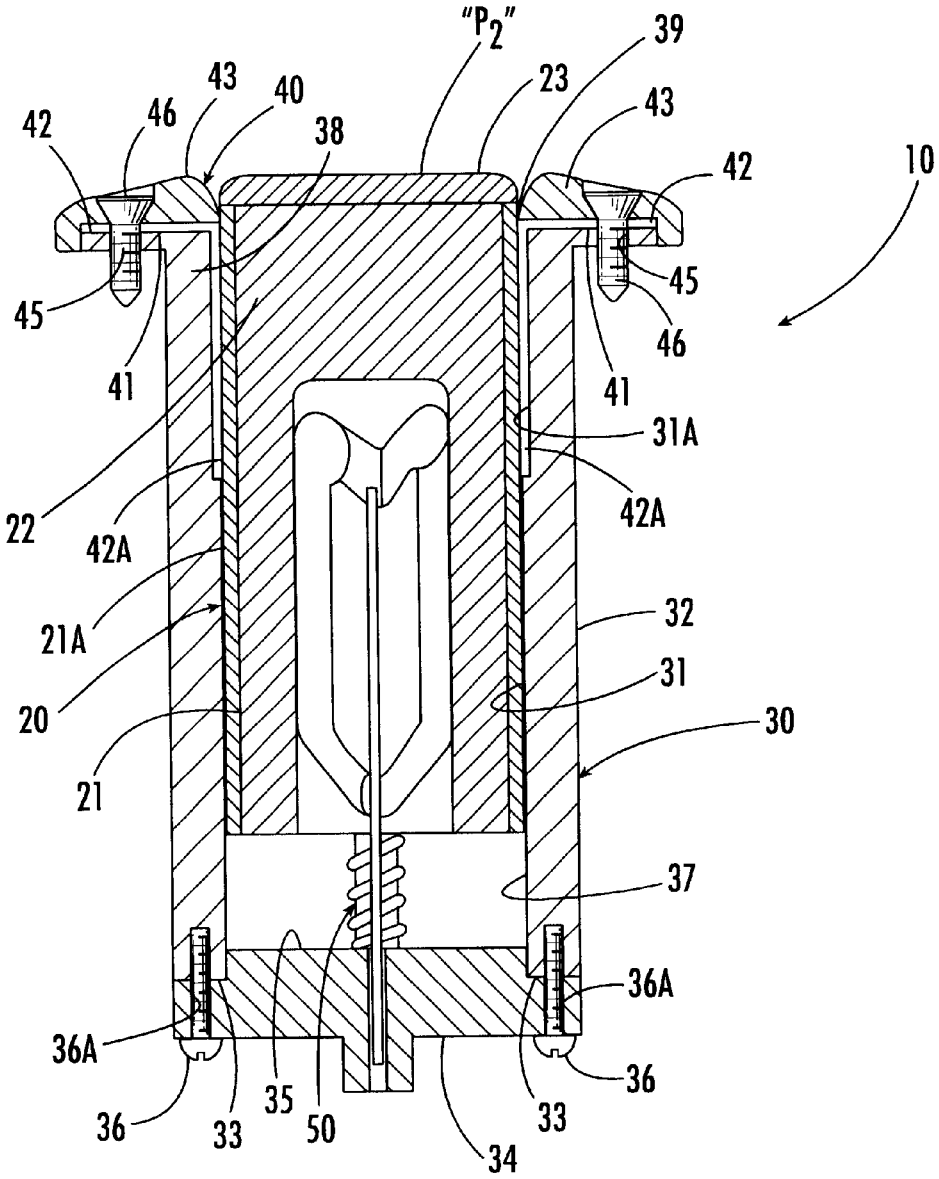
FIG. 2 is a cross-sectional side view of the door safety barrier shown in FIG. 1.

Referring now to FIG. 2, the housing 30 includes interior and exterior cylindrical sidewalls 31 and 32, respectively, which are integrally formed with an end edge 33. A removable base 34 is attached to the end edge 33 and forms an interior floor 35. Interior sidewall 31 and interior floor 35 define a chamber 37 within the housing 30. The base 34 is connected to the end edge 33 by identical threaded screws 36 which are placed in complementary threaded holes 36A. Each hole 36A is defined by and extends through the base 34 and end edge 33. While two screws 36 and two complementary holes 36A are shown in FIG. 2, any number of screws 36 and complementary holes 36 may be employed.

Although the housing 30 may be formed from any suitable materials, the housing 30 is preferably formed from plastic. The plunger 20 is vertically oriented within the chamber 37 and is mounted to the interior floor 35 by a latching assembly 50. As discussed more fully below with reference to FIGS. 9 through 14, the latching assembly 50 moves the plunger 20 between an extended, operative position "$P_1$" shown in FIG. 1 and a retracted, inoperative position "$P_2$" shown in FIG. 2. The plunger 20, housing 30, attachment plate 40 and latching assembly 50 have a common central axis and thus a symmetrical, longitudinal orientation.

The attachment plate 40 includes an annular flange 41. The flange 41 is integrally formed with an upper end 38 of the housing 30 to define an opening 39. A flanged bushing 42 covers the flange 41. The bushing 42 is preferably made of steel or any other suitable, durable substance. The bushing 42 reinforces the flange 41, and includes an integrally formed tubular section 42A which extends through the opening 39 and covers a complementary counter bore 31A defined by the interior sidewall 31. A decorative cap 43 covers the bushing 42. The cap 43 has an annular shape complementary to that of the flange 41, and provides a visually pleasing cover for the attachment plate 40 to help "blend" the barrier 10 into the surrounding interior decor.

Figure 3:
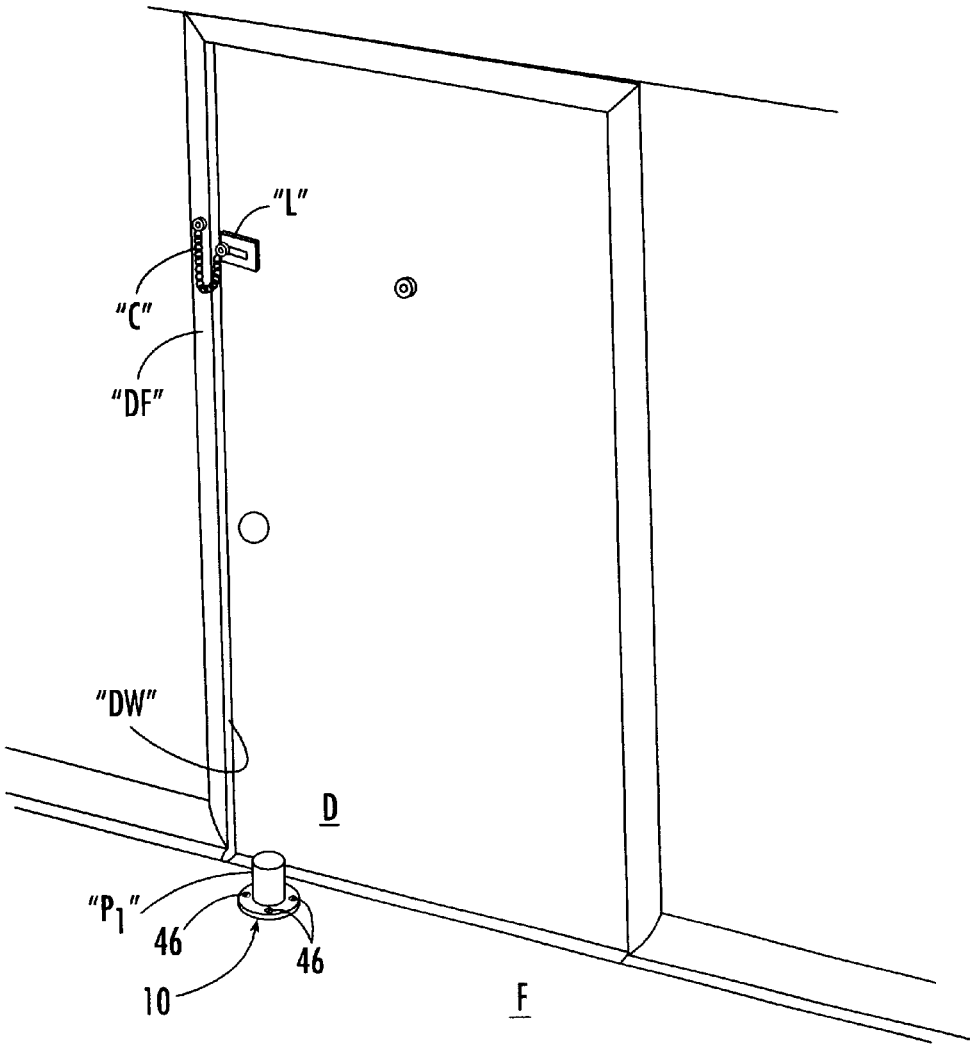
FIG. 3 is an environmental perspective view of the door safety barrier according to FIG. 1 installed on a floor adjacent a door and doorframe.

As is shown in FIG. 2, threaded holes 45 are defined by and extend through the flange 41 and bushing 42. A complementary threaded screw 46 is placed through each hole 45 for securing the attachment plate 40 to the floor. The type of screw 46 used is preferably dictated by the type of floor within which the barrier 10 is being installed. For example, the floor "F" shown in FIG. 3 is preferably formed from wood. Therefore, each screw 46 used in barrier 10 shown in FIG. 3 is preferably a flat-headed wood screw.

The plunger 20 includes a cylindrical sidewall 21 and an upper end 22 which is covered by a decorative upper face plate 23. An annular sleeve 21A, which is preferably formed from steel, overlies sidewall 21. Although the upper face plate 23 and cap 43 may be formed from any suitable substance, they are each preferably formed from wood, plastic, or some other similar, wear-resistant material capable of withstanding repeated, downwardly-directed impacts from an individual's foot as the plunger 20 is moved between the extended, operative position "$P_1$", and the retracted, inoperative position "$P_2$". The upper face plate 23 and cap 43 are also preferably formed from materials that visually enhance the appearance of the barrier 10 and complement the surrounding decor.

Referring again to FIG. 3, the barrier 10 is shown in its extended, operative position "$P_1$" anchored to a floor "F" adjacent a doorway "DW" and door "D". While the floor "F" is preferably formed from wood, the floor "F" may also be formed from concrete, tile, or some other similar hard substance. The barrier 10 serves the same function as the conventional chain latch "L" shown attached to the doorframe "DF" and door "D", which is to allow an individual to partially open the door "D" to view and speak with another person standing on the other side of the doorway "DW", while simultaneously preventing that person from pushing on the door "D" and gaining unwanted entry through the doorway "DW".

Figure 4:
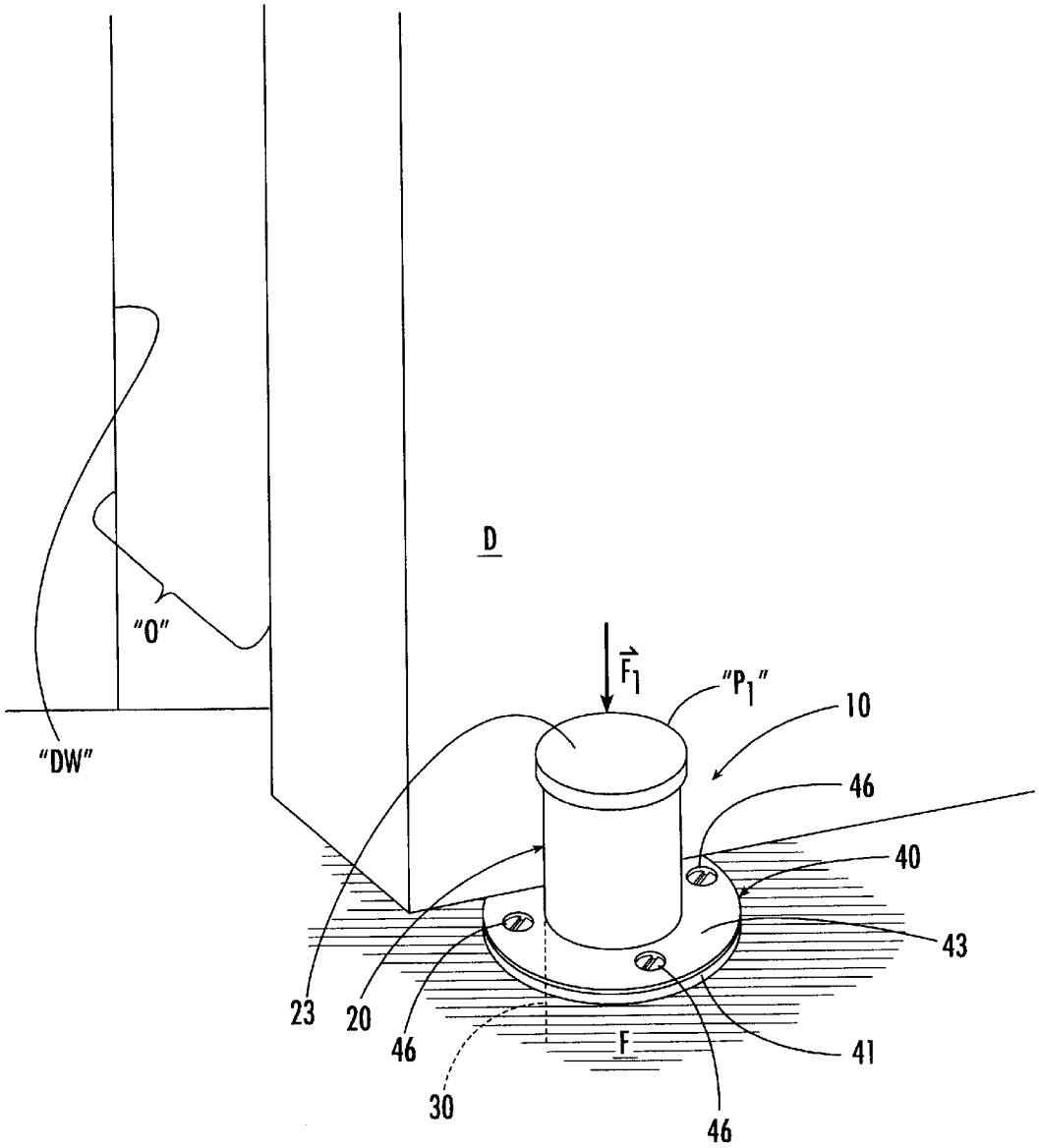
FIG. 4 is a cut-away environmental perspective view of the door safety barrier shown in FIG. 3 in an extended, operative position.

Although the basic function of the barrier 10 and the chain latch "L" are similar, the structure of the barrier 10 and manner in which it is positioned and installed in the floor "F" relative to the door "D" and doorway "DW" makes its protective capabilities far superior to those of the chain latch "L". In particular, a conventional chain latch "L" typically includes a chain "C" which is secured by short wood screws into a soft wooden doorframe "DF". Such screws can be easily torn out of the doorframe "DF" by simply applying force to the side of the door "D" opposite the side upon which the chain latch "L" is installed. An intruder with sufficient body strength can thus force his or her way through the doorway "DW" by simply pushing against the door "D" until the chain latch "L" either breaks or is torn from the doorframe "DF." In contrast, an intruder attempting to pass through a doorway "DW" protected by the barrier 10 will face a significant challenge. FIG. 4 shows the door "D" opened against the extended, operative plunger 20 to create a security opening "O" through which the individual inside may view outside the doorway "DW". The housing 30 is embedded into and extends beneath the floor "F", which enhances the ability of the barrier 10 to withstand pressure. When in the extended, operative position "$P_1$", the plunger 20 not only prevents the door "D" from being fully opened, but is also capable of resisting over ½ ton of static pressure, should an intruder try to force his or her way through the doorway "DW". This effectively prohibits forced entry through the doorway "DW" while simultaneously allowing the individual being threatened enough time to reach a telephone to call for emergency assistance (not shown).

Figure 5:
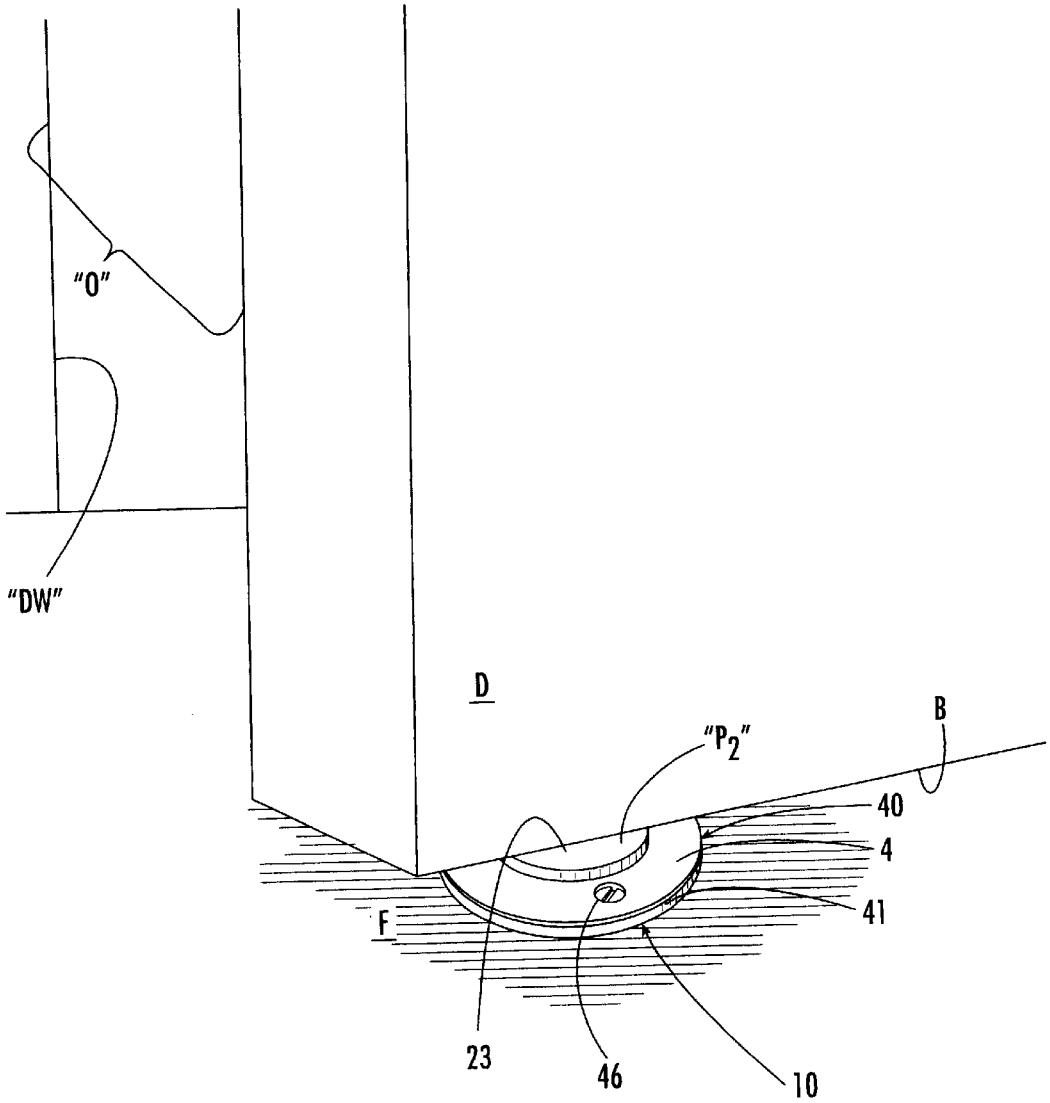
FIG. 5 is a cut-away environmental perspective view of the door safety barrier shown in FIG. 4 in a retracted, inoperative position.

Referring now to FIG. 5, the door barrier 10 is shown in the retracted, inoperative position "$P_2$". As discussed in detail in reference to FIGS. 9 through 14 below, the barrier 10 is moved from the extended, operative position "$P_1$" shown in FIG. 4 to the retracted, inoperative position "$P_2$" shown in FIG. 5 by exerting a force "$F_1$" on the upper face plate 23 in the direction shown in FIG. 4. When in the retracted, inoperative position "$P_2$", the plunger 20 is depressed and held within the housing 30 by the latching assembly 50 at a depth sufficient to permit the bottom edge "B" of the door "D" to clear the upper face 23 of the plunger 20 and pass over the barrier 10. This also permits an individual to pass through the open doorway "DW". For most standard floors, in order for the door "D" to clear the upper face 23, the distance between the bottom of the flange 41 and the top of the upper face 23 when the barrier 10 is in the retracted, inoperative position "$P_2$" must be no more than 5⁄16 inch.

Figure 6:
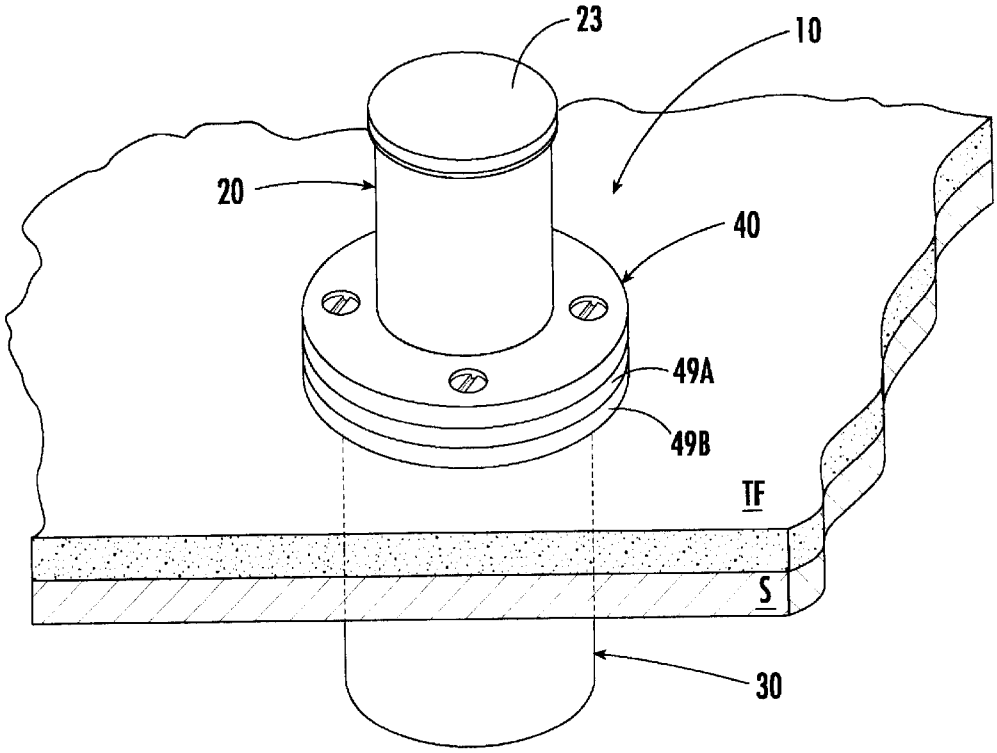
FIG. 6 is a cut-away environmental perspective view of the door safety barrier according to FIG. 1 installed on a tile floor.

Referring now to FIG. 6, the barrier 10 is shown installed into a tile floor "TF", with the housing 30 positioned through and extending beneath the tile floor "TF" and a subfloor "S". Two annular spacers 49A and 49B are positioned between the attachment plate 40 and the tile floor "TF". The spacers 49A and 49B are preferably formed from rubber, and protect the tile floor "TF" from cracks and other damage which would otherwise result if the flange 41 and tile floor "TF" were in direct contact with each other. Although two spacers 49A and 49B are shown in FIG. 6, any number of spacers 49A and 49B may be used. Furthermore, use of the spacers 49A and 49B is not restricted to protecting tile or other sensitive flooring surfaces. The spacers 49A and 49B may also be used on uneven or low floors to adjust the height of the barrier 10 so that the upper face plate 23 is positioned closer to the bottom of the door when the barrier 10 is in the retracted, operative position "$P_2$".

Figure 7:
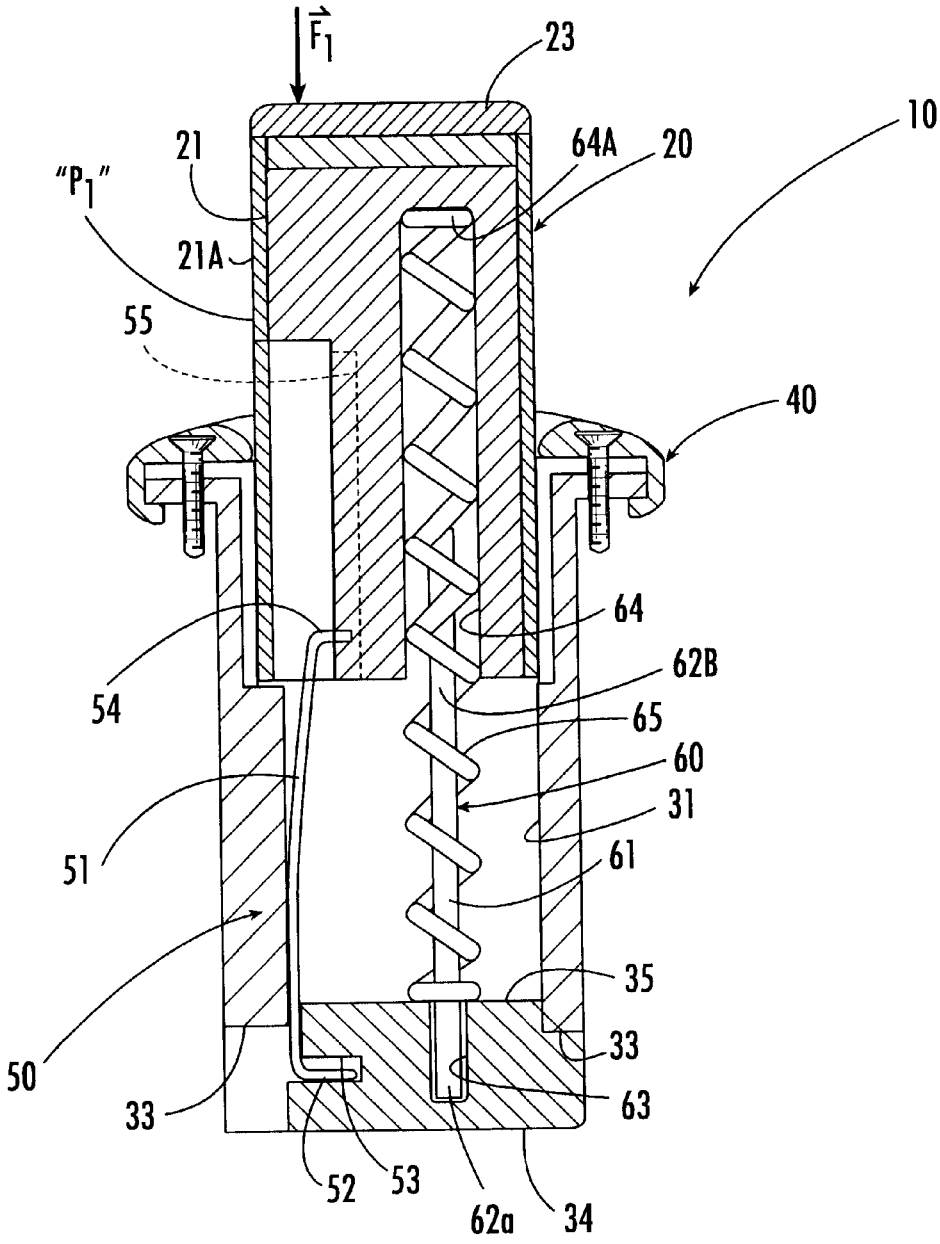
FIG. 7 is a cross-sectional side view of the door safety barrier shown in FIG. 1 in its extended, operative position.

Referring now to FIG. 7, the structure of the latching assembly 50 is shown in a barrier 10 that is in the extended, operative position "$P_1$". The latching assembly 50 includes a follower member 51 having a first hooked end 52 relatively loosely positioned within a complementary first hole 53 defined within the base 34 of the housing 30, and a second hooked end 54 which cooperates with a grooved cam 55 defined in the sidewall 21 of the plunger 20.

The barrier 10 also includes a spring assembly 60. The spring assembly 60 cooperates with the cam 55 and follower member 51 to move the plunger 20 between the extended, operative position "$P_1$" shown in FIG. 4 and the retracted, inoperative position "$P_2$" shown in FIG. 5 in response to foot-actuated, downwardly-directed pressure on the upper face plate 23 of the plunger 20. Referring again to FIG. 7, the spring assembly 60 includes an elongate rod 61 attached to the interior floor 35 by a first end 62A which is inserted within a complementary hole 63 in the base 34. The rod 61 also includes a second end 62B which is received within and communicates with an axially-extending bore 64 defined within the plunger 20. A spring 65 is formed around and extends along the rod 61. The spring 65 is preferably a compression spring, and is captured between the interior floor 34 and an interior end wall 64A of the bore 64. The spring 65 axially compresses and expands in response to the force "$F_1$" on the upper face plate 23 of the plunger 20. In the absence of the force "$F_1$", the spring 65 expands, and biases the plunger 20 toward the extended, operative position "$P_1$".

Figure 8A:
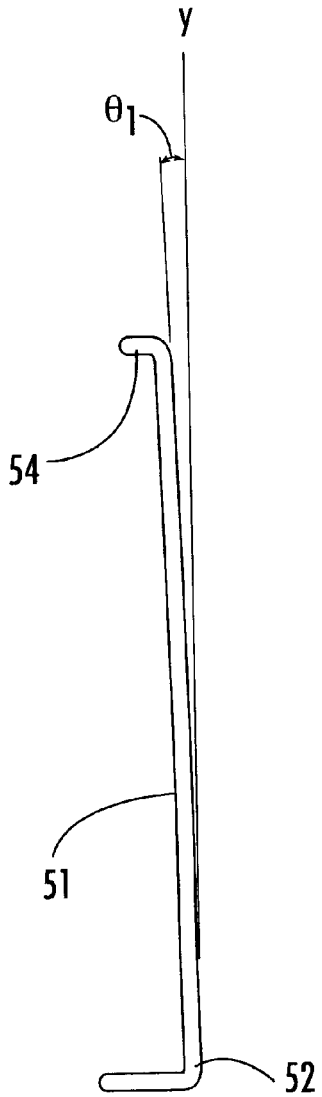
FIG. 8A is a side elevation of the follower member of the door safety barrier shown in FIG. 7.
Figure 8B:
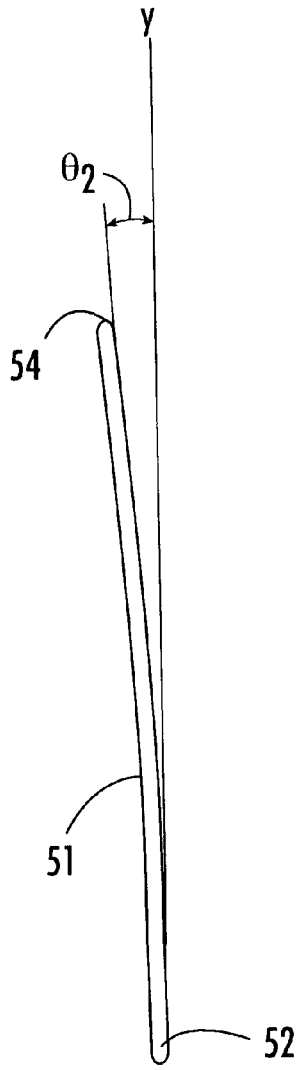
FIG. 8B is another side elevation of the follower member shown in FIG. 8A.

Referring now to FIGS. 8A and 8B, the structure of the follower member 51 is shown. The follower member 51 is preferably formed from an elongate, inflexible steel rod. As is shown in FIG. 8A, the second hooked end 54 is offset at an angle $\theta_1$ from the longitudinal axis "y" of the follower member 51, which causes the second end 54 to be deflected toward and remain engaged with the surface of the cam 55 at all times during movement of the plunger 20. As is shown in FIG. 8B, the second hooked end 54 is further offset at a second angle $\theta_2$ to the longitudinal axis "y" of the follower member 51, which further biases the second end 54 toward the grooved cam 55 to ensures that the follower member 51 travels smoothly around the cam 55.

Figure 9:
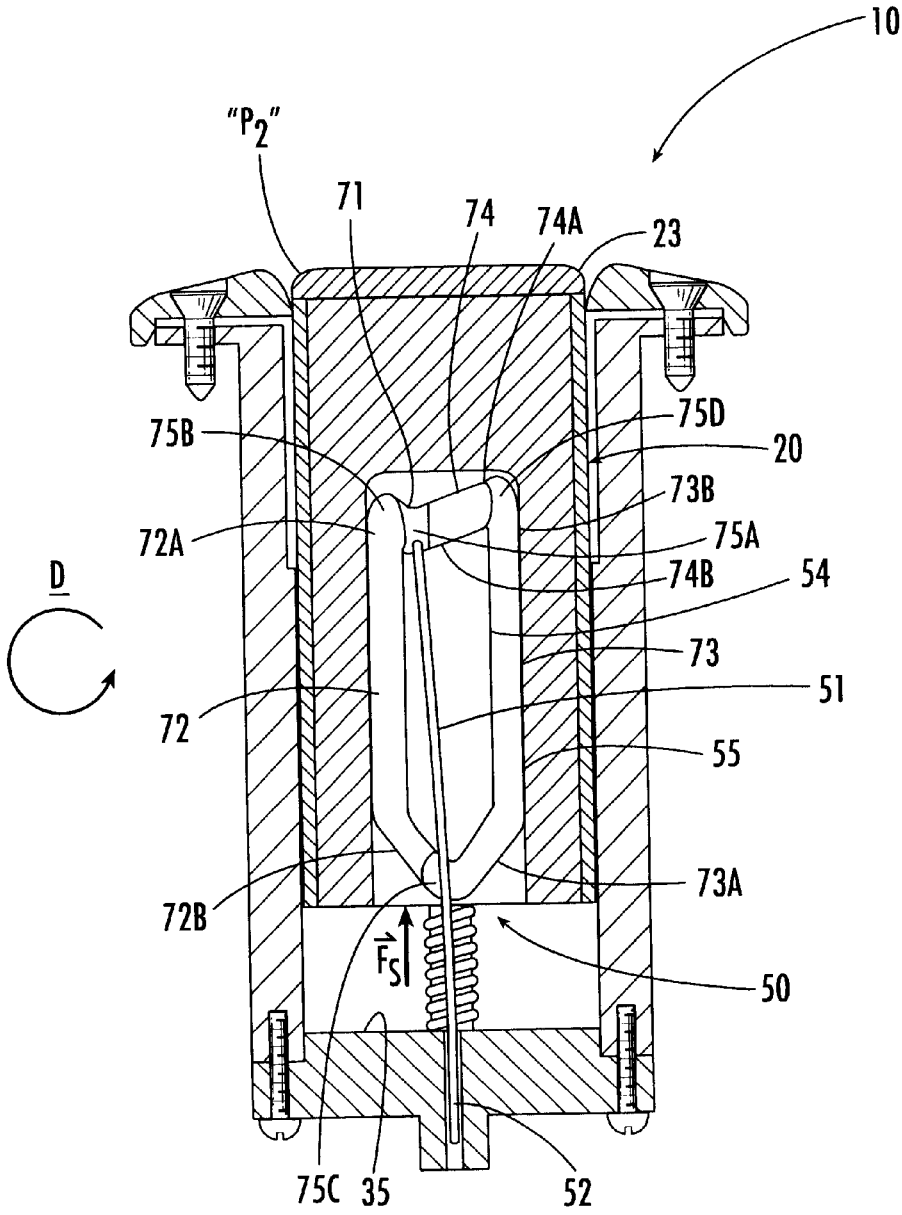
FIG. 9 is a cross-sectional side view of the door safety barrier in its retracted, inoperative position.

Referring now to FIGS. 9 through 14, the manner in which the latching assembly 50 moves the plunger 20 between the retracted, inoperative position "$P_2$" and the expanded, operative position "$P_1$" is shown. As is shown in FIG. 9, the grooved cam 55 includes four cam segments 71, 72, 73, and 74, which are connected end-to-end to form the generally heart-shaped cam 55. Specifically, cam segments 71, 72, 73, and 74 include first ends 71A, 72A, 73A and 74A, which are integrally formed with respective second ends 74B, 71B, 72B and 73B to define recessed release points 75A, 75B, 75C and 75D, respectively. Each first end 71A, 72A, 73A and 74A is elevated higher than its corresponding second end 71B, 72B, 73B and 74A. The cam segments 71, 72, 73 and 74 thus slope downwardly toward each of the respective release points 75A, 75B, 75C and 75D, which causes the follower member 51 to travel within the grooved cam 55 in the counter-clockwise direction "D" shown and cooperate with the spring assembly 60 to move the plunger 20 between the retracted, inoperative position "$P_2$" and the extended, inoperative position "$P_1$"

FIG. 9 shows the barrier 10 in the retracted, inoperative position "$P_1$" with the second end 54 of the follower member 51 retained within the first release point 75A of the cam 55. In the absence of a downwardly-directed force "$F_1$" on the upper face of the plunger 20, the second end 54 will remain positioned within the first release point 75A and will hold the barrier 10 in the retracted, inoperative position "$P_2$" indefinitely. Under such circumstances, the spring 65 exerts a force "$F_S$" on the plunger 20 which biases the plunger 20 away from the follower member 51, and thus retains the second end 54 within the first release point 75A.

Figure 10:
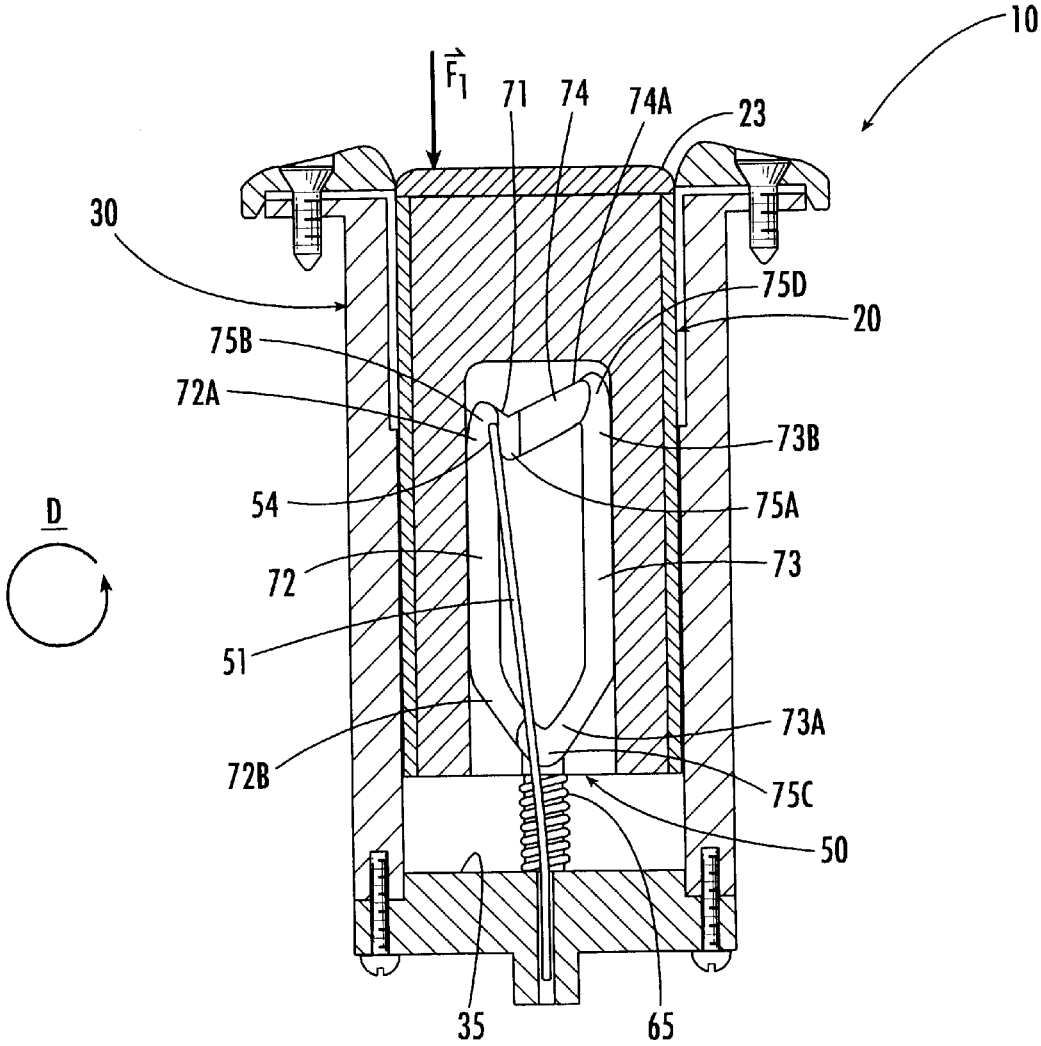
FIG. 10 is a cross-sectional side view of the door safety barrier shown in FIG. 9 being moved from the retracted, inoperative position to the extended, operative position.
Figure 11:
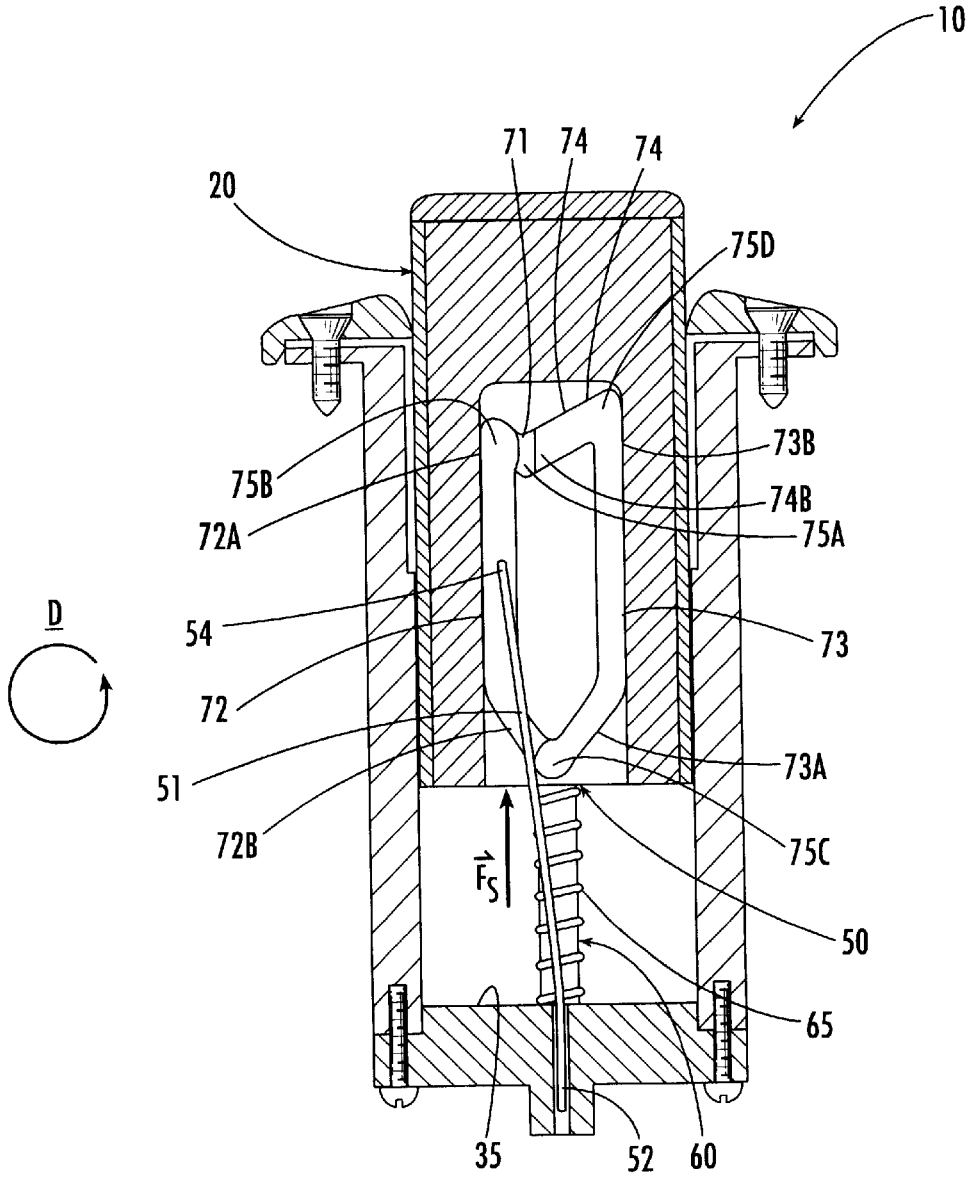
FIG. 11 is another cross-sectional side view of the door safety barrier shown in FIG. 9 being moved from the retracted, inoperative position to the extended, operative position.
Figure 12:
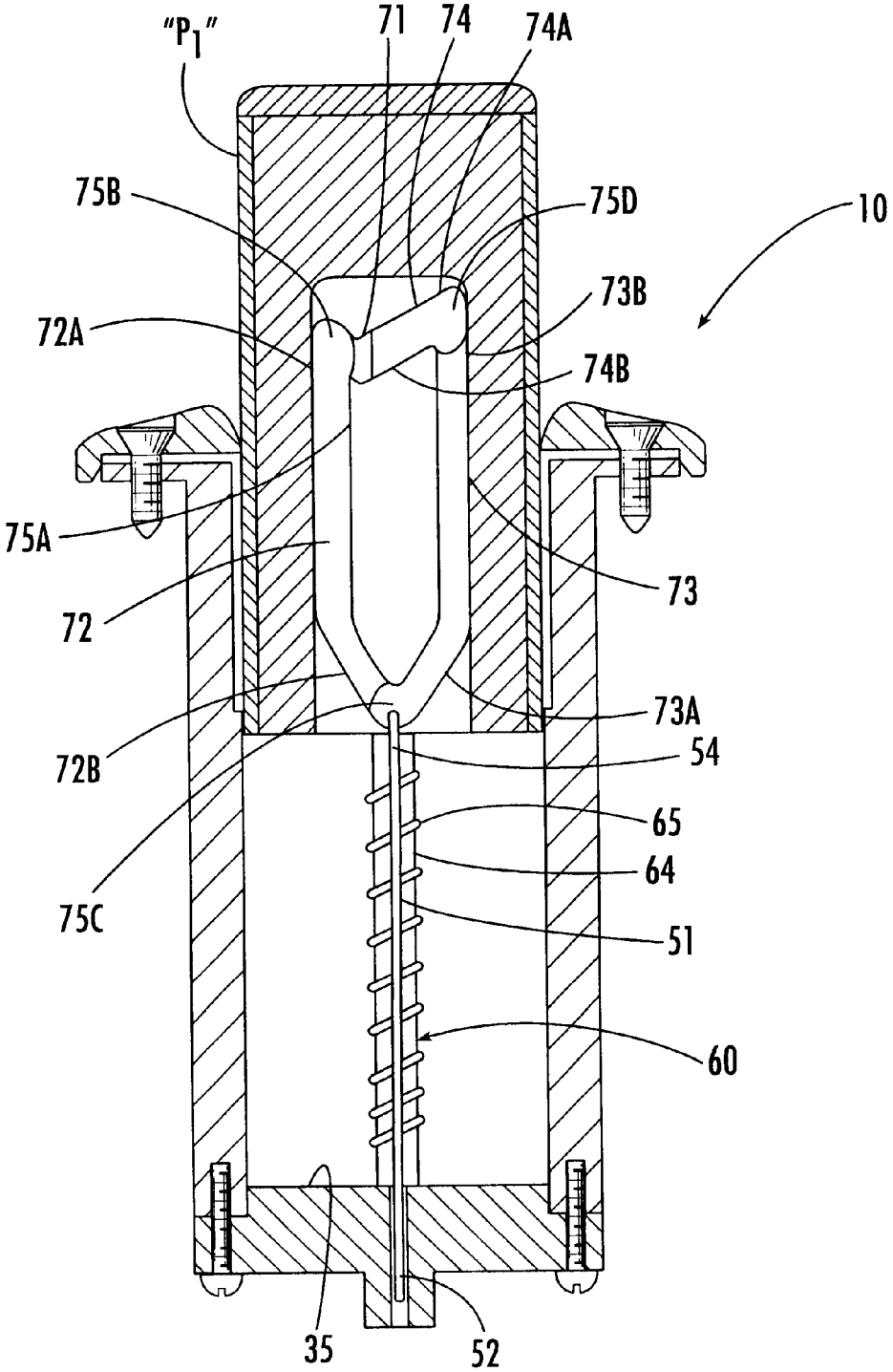
FIG. 12 is a cross-sectional side view of the door safety barrier shown in FIG. 9 in the extended, operative position.

Referring now to FIG. 10, the plunger 20 is moved from the retracted, inoperative position "$P_2$" by introducing a downwardly directed force "$F_1$" on the upper face plate 23. The force "$F_1$" is created when an individual uses his or her foot to depress the plunger 20, which moves the plunger 20 toward the interior floor 35 of the housing 30, and simultaneously causes the spring 65 to contract. This releases the second end 54 of the follower member 51 from release point 75A. The second end 54 is moved toward the second end 71B of cam segment 71 to release point 75B. The individual then removes his or her foot from the upper face plate 23, which causes the spring 65 to fully expand. As is shown in FIG. 11, the resulting force "$F_S$" of the expanding spring 65 on the plunger 20 causes the plunger 20 to move away from the interior floor 35, and simultaneously prompts the second end 54 of the follower member 51 to travel from the first end 72A down the length of cam segment 72 to second end 72B. As is shown in FIG. 12, the second end 54 of the follower member 51 travels along cam segment 72 until it encounters and is captured within release point 75C. Once the second end 54 is retained within release point 75C, the follow member 51 cooperates with the spring assembly 60 to maintain the plunger 20 in the extended, operative position "$P_1$".

Figure 13:
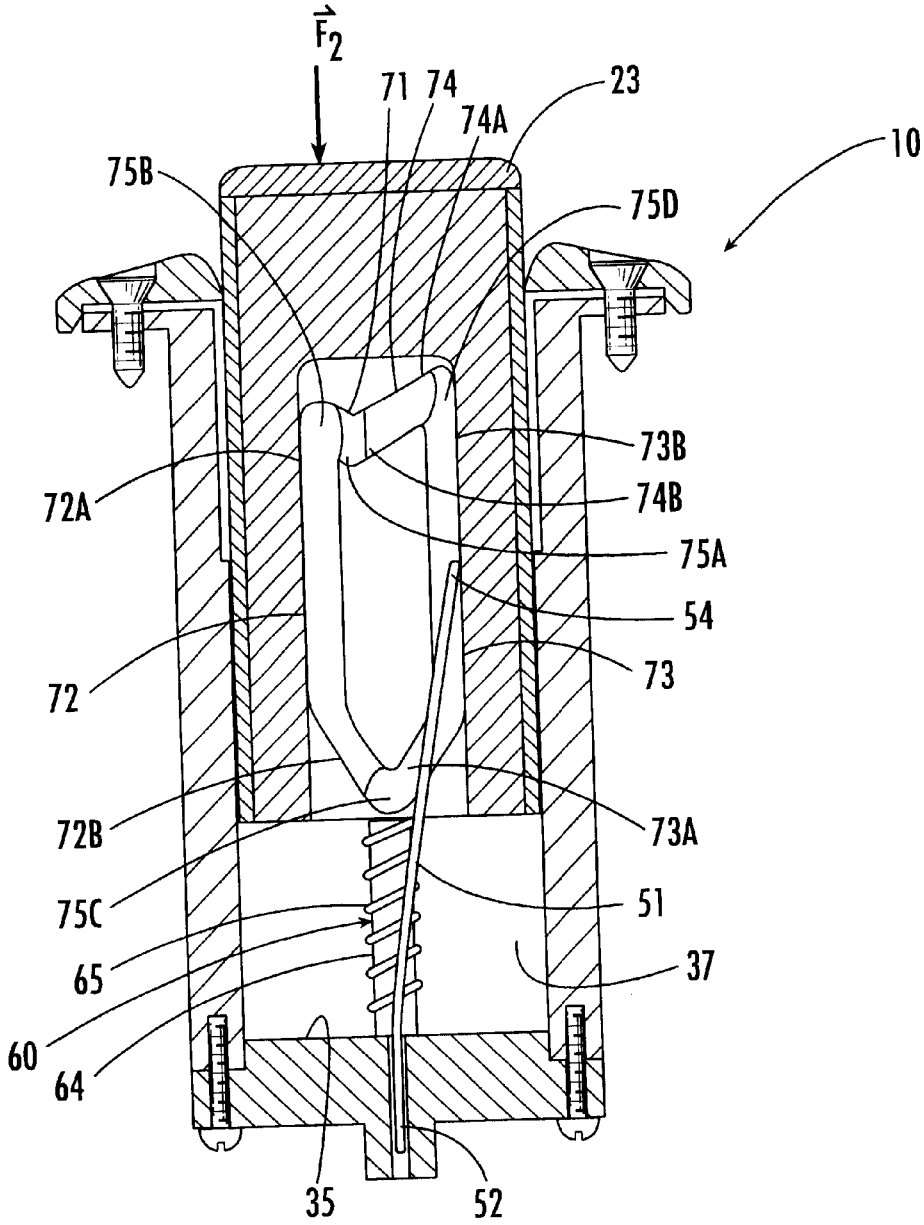
FIG. 13 is a cross-sectional side view of the door safety barrier being moved from the extended, operative position to the retracted, inoperative position.
Figure 14:
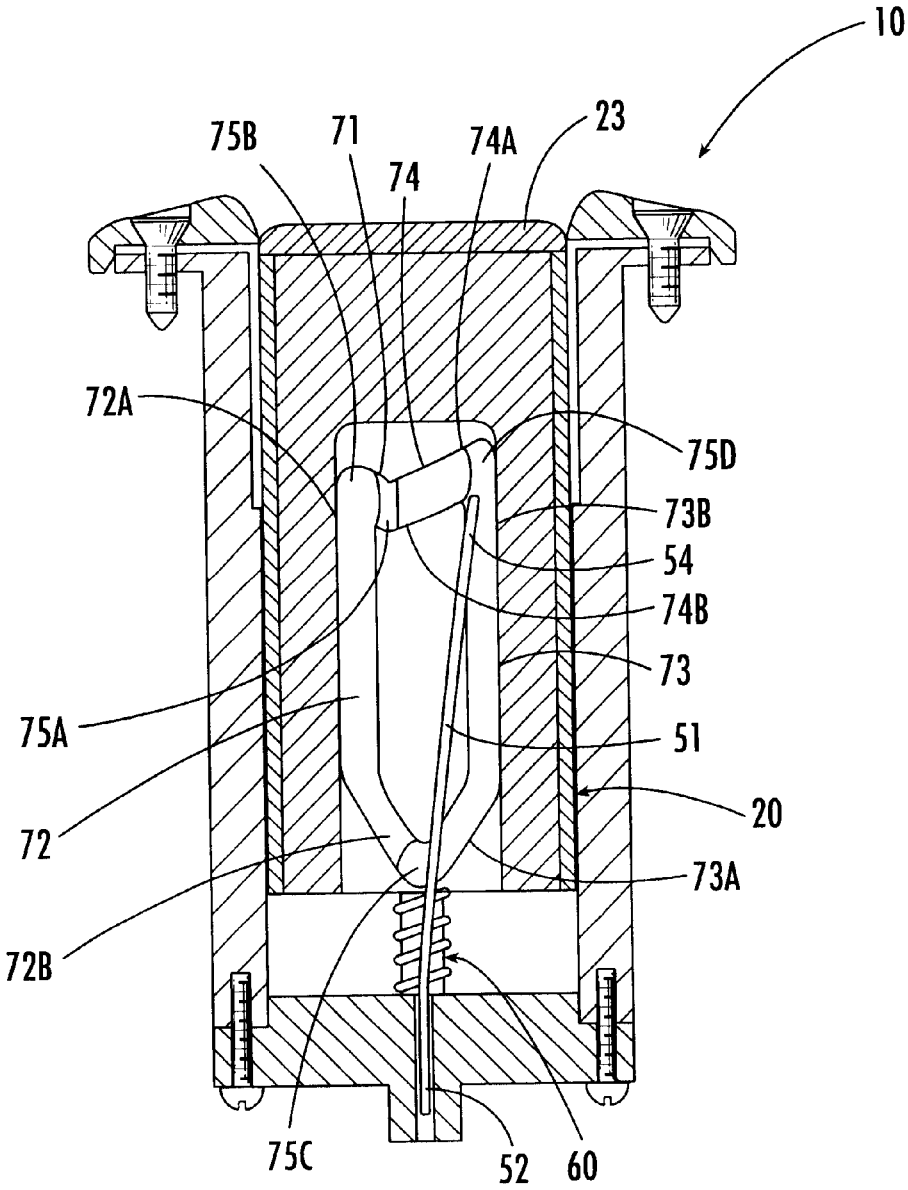
FIG. 14 is another cross-sectional side view of the door safety barrier being moved from the extended, operative position to the retracted inoperative position.

To move the plunger 20 from the extended, operative position "$P_1$" shown in FIG. 12 back to the retracted, inoperative position "$P_2$" shown in FIG. 9, the user merely depresses the plunger 20 again to create a second downwardly-directed force "$F_2$" on the upper face plate 23, which urges the plunger 20 back into the interior chamber 37. As shown in FIG. 13, this simultaneously causes the spring 65 to contract along the rod 64 and releases the second end 54 of the follower member 51 from release point 75C. The second end 54 of the follower member 51 then travels from the first end 73A to the second end 73B of cam segment 73, where it encounters release point 75D, which in turn prompts the user to remove his or her foot from the upper face plate 23. As is shown in FIG. 14, this removes the force "$F_2$" from the upper face plate 23. The absence of the force "$F_2$" on the plate 23 causes the spring 65 to expand and exert a corresponding spring force "$F_{S2}$" on the plunger 20. The second end 54 of the follower member 51 simultaneously moves away from release point 75D, and travels from the elevated first end 74A down cam segment 74 to second end 74B. Upon arrival at the second end 74B, the second end 54 of the follower member 51 is once again captured within release point 75A, where it cooperates with the spring assembly 60 to maintain the plunger 20 in the retracted, inoperative position "$P_2$" shown in FIG. 9.

Figure 15:
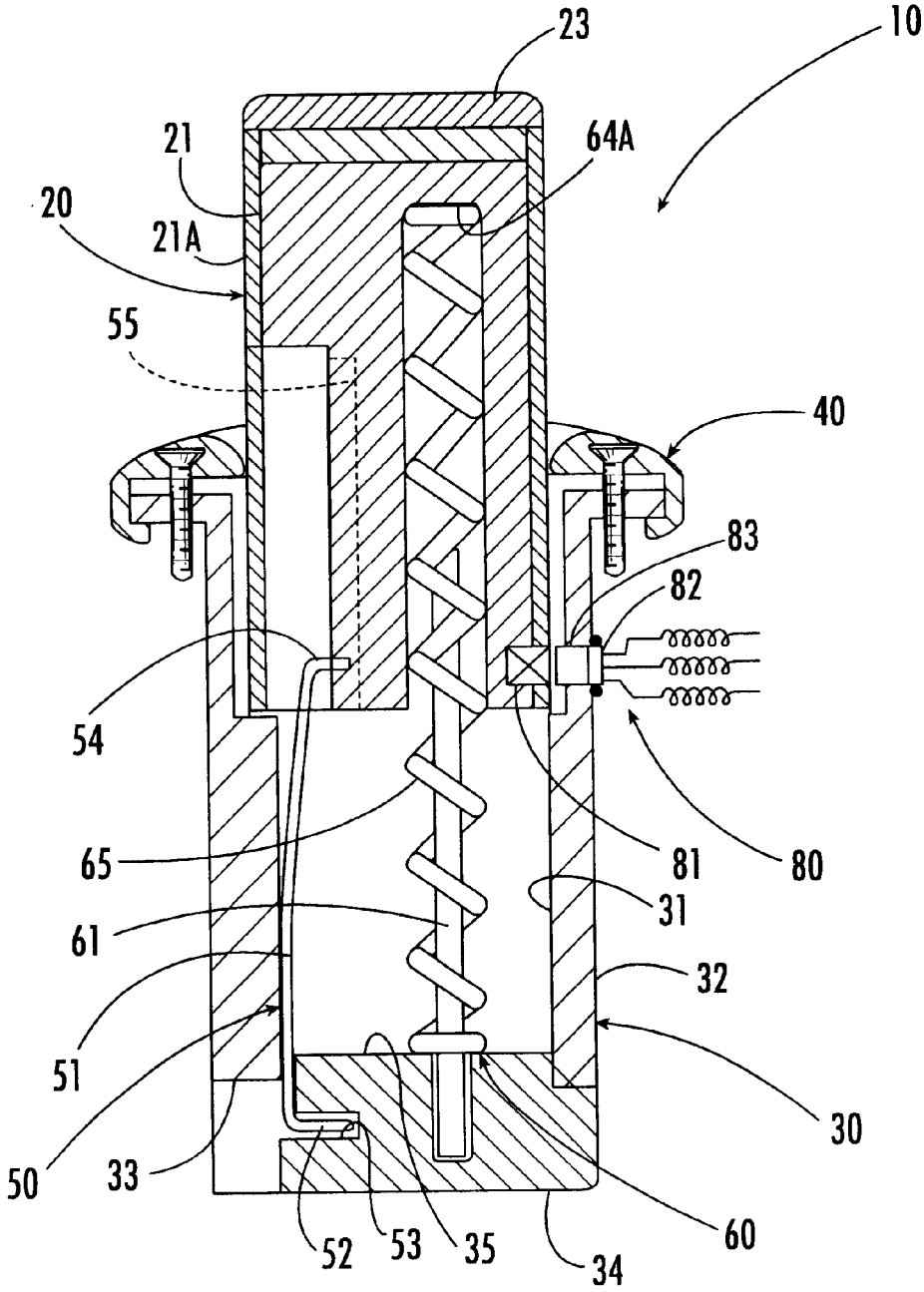
FIG. 15 is a cross-sectional side view of a door safety barrier according to another preferred embodiment of the invention.
Figure 16:
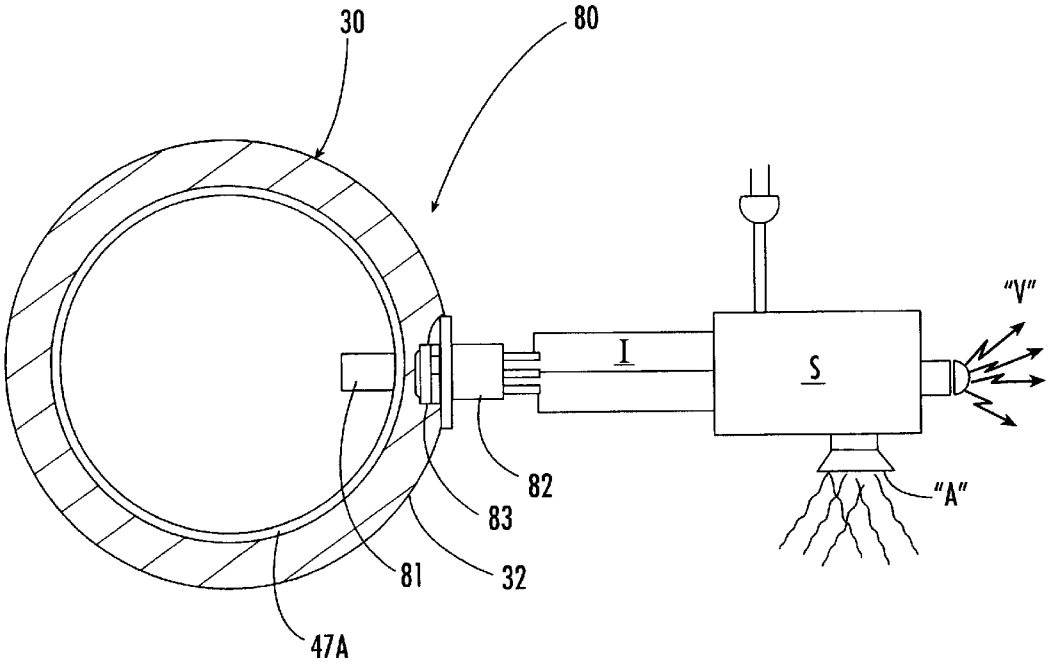
FIG. 16 is a top plan schematic, cross-sectional view of the door safety barrier shown in FIG. 15 connected to a remote alarm system.

Referring now to FIG. 15, the door barrier 10 may also include an optional alarm system 80. The alarm system 80 is preferably an electromagnetic system, and includes a magnet 81 embedded within the cylindrical sidewall 21 of the plunger 20. A complementary sensor 82 is positioned within a holder 83 which is embedded into the outer sidewall 32 of the housing 30. The sensor 82 is preferably a Hall Effect sensor. As shown in FIG. 16, the sensor 82 cooperates with the magnet 81 to transmit an electromagnetic signal "I" to a remote alarm unit system "S", where the signal is translated into an audible or visual alarm "A" or "V", respectively.

A door safety barrier has been disclosed. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A door safety barrier for being positioned adjacent a doorway having a door mounted therein for interfering with movement of the door relative to the doorway and defining a security opening between the door and the doorway for preventing entry therethrough, comprising:

(a) a housing for being embedded into a floor adjacent the door, said housing defining a chamber therein;

(b) an elongate plunger positioned within the chamber for reciprocating movement between an extended, operative position above the floor for engaging a side of the door to prevent movement of the door past said plunger, and a retracted, inoperative position below the bottom of the door for permitting passage of the door over the plunger; and (c) a latch assembly cooperating with the housing and the plunger for alternately locking the plunger in said extended, operative and retracted inoperative positions, respectively, said latch assembly comprising a follower member having a first end engaged with the interior floor of the housing and a second end for slidably engaging a complementary cam groove defined in a sidewall of the plunger for selectively moving the plunger between the extended, operative and retracted, inoperative positions.

2. A door safety barrier according to claim 1, and including a flange attached to an upper edge of the housing and adapted for being secured to an upper surface of the floor.

3. A door safety barrier according to claim 2, and including a plurality of spaced-apart holes defined by the flange and adapted for receiving screws therethrough for attaching the flange to the upper surface of the floor.

4. A door safety barrier according to claim 2, and further comprising at least one annular spacer positioned between said flange and the upper surface of the floor for preventing damage to the upper surface.

5. A door safety barrier according to claim 1, wherein the latch assembly further comprises an elongate rod having a first end positioned on said interior floor of the housing and a second end centrally disposed within a concentrically-positioned bore defined within and extending along the axial length of the plunger for supporting the plunger within the housing.

6. A door safety barrier according to claim 5, wherein said latch assembly further comprises a spring formed around and extending along the length of said rod and captured between the floor of the housing and an interior surface defining said bore for moving the plunger through said opening of the chamber by expanding and contracting in response to the presence and absence, respectively, of downward pressure on an upper face of the plunger.

7. A door safety barrier according to claim 1, wherein said second end of said follower member comprises a hooked tip captured within said cam groove for selectively engaging complementary first and second release points defined within and interconnected by the cam groove for maintaining the plunger in the retracted, inoperative position and the extended, operative position, respectively, in the absence of downward pressure on said upper face of the plunger.

8. A door safety barrier according to claim 1, and including a sensor in communication with the door safety barrier for producing an alarm in response to stimuli detected by said sensor.

9. A door safety barrier according to claim 8, wherein said sensor comprises an electromagnetic sensor.

10. A door safety barrier according to claim 9, wherein said electromagnetic sensor comprises a magnetic field sensitive device connected to the housing and cooperating with a complementary magnetic field producing device connected to the plunger.

11. A door safety barrier according to claim 9 or 10, wherein said magnetic field sensitive device comprises at least one Hall Effect sensor.

12. A door safety barrier according to claim 9 or 10, wherein said magnetic field producing device comprises at least one magnet.

13. A method for installing a door safety barrier, comprising the steps of:

(a) providing a door safety barrier for being positioned adjacent a doorway having a door mounted therein for interfering with movement of the door relative to the doorway and defining a security opening between the door and the doorway for preventing entry therethrough, comprising:

(i) a housing for being embedded into a floor adjacent the door and secured to an upper surface of the floor, said housing defining a chamber therein;

(ii) an elongate plunger positioned within the chamber for reciprocating movement between an extended, operative position above the floor for engaging a side of the door to prevent movement of the door past said plunger, and a retracted, inoperative position below the bottom of the door for permitting passage of the door over the plunger; and (iii) a latch assembly cooperating with the housing and the plunger for alternately locking the plunger in said extended, operative and retracted inoperative positions, respectively, said latch assembly comprising a follower member having a first end engaged with the interior floor of the housing and a second end for slidably engaging a complementary cam groove defined in a sidewall of the plunger for selectively moving the plunger between the extended, operative and retracted, inoperative positions;

(b) drilling a hole through the floor, said hole defined by cylindrical sidewalls adapted for receiving the housing therethrough;

(c) positioning the door safety barrier through the hole such that the housing engages said cylindrical sidewalls for permitting reciprocating movement of the plunger through the hole between said extended, operative and retracted, inoperative positions; and (d) securing the housing to the upper surface of the floor.

14. A method according to claim 13, wherein said securing comprises attaching a flange connected to an upper edge of the housing to the upper surface of the floor.

15. A method according to claim 14, wherein said securing further comprises placing a plurality of screws through complementary spaced-apart holes defined by said flange and adapted for receiving said screws therethrough for attaching the flange to the upper surface of the floor.

16. A method according to claim 14 or 15, and further comprising the step of providing at least one annular spacer for being positioned between the flange and the upper surface of the floor for preventing damage to the upper surface.

17. A method according to claim 16, and further comprising the step of positioning said at least one spacer around an exterior sidewall of said housing prior to positioning the door safety barrier through the hole.

18. A method for installing a door safety barrier, comprising the steps of:

(a) providing a door safety barrier for being positioned adjacent a doorway having a door mounted therein for interfering with movement of the door relative to the doorway and defining a security opening between the door and the doorway for preventing entry therethrough, comprising:

(i) a housing for being embedded into a floor adjacent the door and secured to an upper surface of the floor, said housing defining a chamber therein;

(ii) an elongate plunger positioned within the chamber for reciprocating movement between an extended, operative position above the floor for engaging a side of the door to prevent movement of the door past said plunger, and a retracted, inoperative position below the bottom of the door for permitting passage of the door over the plunger; and (iii) a latch assembly cooperating with the housing and the plunger for alternately locking the plunger in said extended, operative and retracted inoperative positions, respectively;

(b) providing an annular spacer for being positioned between the flange and the upper surface of the floor for preventing damage to the upper surface;

(c) positioning said spacer around an exterior sidewall of said housing;

(d) drilling a hole through the floor, said hole defined by cylindrical sidewalls adapted for receiving the housing therethrough;

(e) positioning the door safety barrier through the hole such that the housing engages said cylindrical sidewalls for permitting reciprocating movement of the plunger through the hole between said extended, operative and retracted, inoperative positions; and (f) securing the housing to the upper surface of the floor.

* * * * *